US010969110B2

(12) United States Patent
Gorst

(10) Patent No.: US 10,969,110 B2
(45) Date of Patent: Apr. 6, 2021

(54) UNIVERSAL HOUSING FOR A HOT SURFACE IGNITER

(71) Applicant: Malcolm Gorst, Newton Abbot (GB)

(72) Inventor: Malcolm Gorst, Newton Abbot (GB)

( * ) Notice: Subject to any disclaimer, the term of this patent is extended or adjusted under 35 U.S.C. 154(b) by 355 days.

(21) Appl. No.: 15/932,715

(22) Filed: Apr. 11, 2018

(65) Prior Publication Data

US 2019/0024893 A1 Jan. 24, 2019

Related U.S. Application Data

(60) Provisional application No. 62/603,032, filed on May 16, 2017.

(51) Int. Cl.

| | |
|---|---|
| ***F24C 3/10*** | (2006.01) |
| ***F23Q 7/14*** | (2006.01) |
| ***F23Q 9/14*** | (2006.01) |
| ***F23Q 7/22*** | (2006.01) |
| ***F23Q 7/00*** | (2006.01) |

(52) U.S. Cl.

CPC ..... *F24C 3/103* (2013.01); *F23Q 7/00* (2013.01); *F23Q 7/14* (2013.01); *F23Q 7/22* (2013.01); *F23Q 9/14* (2013.01); *F23D 2207/00* (2013.01)

(58) Field of Classification Search

CPC ... F24C 3/103; F23Q 7/00; F23Q 7/14; F23Q 7/22; F23D 2207/00

See application file for complete search history.

(56) References Cited

U.S. PATENT DOCUMENTS

| | | | | |
|---|---|---|---|---|
| 2,881,363 A | | 4/1959 | Edgar | |
| 3,076,113 A | * | 1/1963 | Candelise | H01R 13/5219 313/135 |
| 4,177,034 A | | 12/1979 | Jones | |
| 4,307,316 A | * | 12/1981 | McKechnie | H01T 13/14 313/135 |
| 4,557,229 A | * | 12/1985 | Kashima | F02P 15/02 123/169 E |
| 4,846,671 A | * | 7/1989 | Kwiatek | F24C 3/085 431/266 |
| 4,854,857 A | | 8/1989 | Houtman | |
| 5,200,574 A | * | 4/1993 | Cunningham | B60R 21/2644 102/202.2 |
| 5,393,224 A | | 2/1995 | Allen et al. | |
| 5,464,345 A | | 11/1995 | Kwiatek | |
| 5,911,572 A | * | 6/1999 | Williams | F24C 3/103 126/39 E |
| 6,059,479 A | * | 5/2000 | Clune | F23Q 3/006 403/24 |
| 2001/0051322 A1 | * | 12/2001 | Heck | F23Q 3/006 431/258 |
| 2014/0377711 A1 | * | 12/2014 | Blalock | F24C 3/103 431/258 |

* cited by examiner

*Primary Examiner* — Ryan A Reis

(74) *Attorney, Agent, or Firm* — Boag Law, PLLC

(57) ABSTRACT

Herein disclosed is universal housing for a hot surface igniter that can be removed and/or easily installed by the consumer without the need for numerous tools or assistance from experienced maintenance personnel. The igniter housing is universal and is functional for use with substantially any apparatus or device which requires a hot surface igniter. The universal housing is of simple construction formed from only two components. Various embodiments are disclosed for construction of the two components and also various attachment means are described.

10 Claims, 2 Drawing Sheets

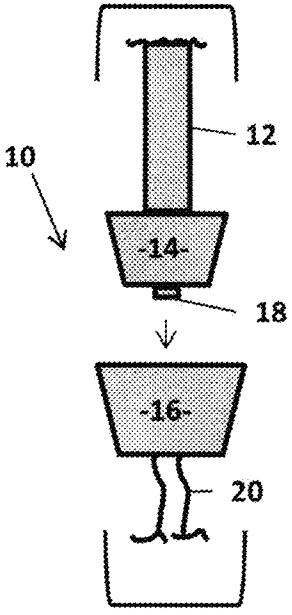
FIG. 4
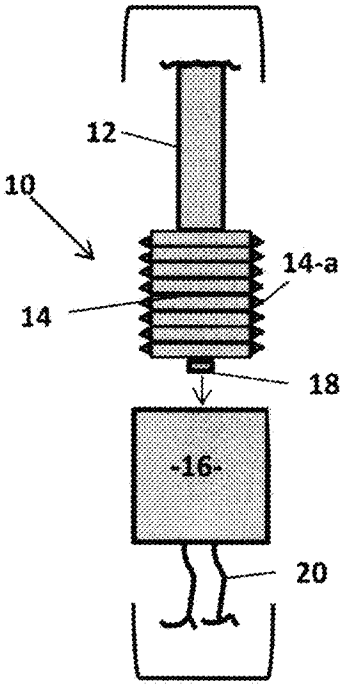
FIG. 3
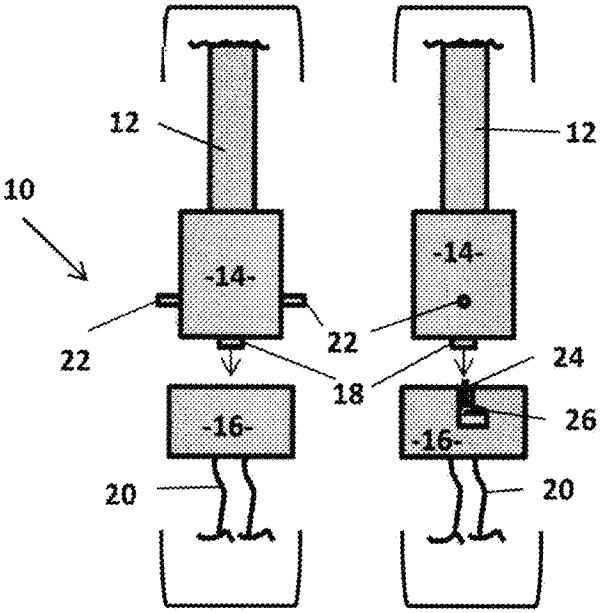
FIG. 2
FIG. 1

UNIVERSAL HOUSING FOR A HOT SURFACE IGNITER

CROSS-REFERENCE TO RELATED APPLICATION

This application claims the benefit of Provisional Patent Application Ser. No. 62/603,032, filed May 16, 2017 by the present inventor, which is incorporated by reference.

FIELD OF THE INVENTION

The present invention relates in general to the construction of an igniter housing but more particularly pertains to an igniter housing that facilitates the removal and replacement of an igniter. Due to the construction of the igniter housing it can be removed and/or easily installed by the consumer without the need for numerous tools or assistance from experienced maintenance personnel. Furthermore the igniter housing is universal and is functional for use with substantially any apparatus or device which requires a hot surface igniter.

BACKGROUND OF THE INVENTION

There are several problems pertaining to the installation, removal, replacement, and servicing of conventional hot surface igniter housings. For example igniters associated with cook stoves, heaters, motors, machines or the like tend to accumulate debris or may become rusted, which in turn makes it difficult to remove the igniter housing. Furthermore typical igniter housings are fragile and easily broken. Most often the igniters of this type are typically mounted with hex screws, bolts, brackets, etc. These types of mountings are simply inefficient and not easily removed or replaced by the consumer. Thus, servicing of an igniter is difficult, inconvenient, unpleasant, and time-consuming. More often than not the consumer must contact experienced maintenance personnel for assistance which is not only very costly but also very frustrating, time-consuming, and simply not feasible.

Another problem is that special tools are required to change typical igniters. Each manufacturer requires a different method or assembly for attaching their igniter. Some manufactures use inch pattern hex screws, other manufacturers use metric hex screws, while still others use various and sundry screws or other fasteners such as brackets. Thus, maintenance personnel require a large number of tools in order to perform what should be a simple operation.

To resolve the above noted problems some attempts are illustrated within the following prior art. For example, U.S. Pat. No. 5,393,224 discloses a system that requires the use of special igniters of a specific diameter and length and having a rimmed characteristic. Only those igniters having the exact criteria may be used because they are the only ones that will fit in the sleeve. Further, the method requires the use of both hands, one to hold the igniter electrode and the other to lift the clip to remove the igniter electrode. Complex igniter electrode designs require manufacturing changes that reduce the economic benefit recovered from saved maintenance costs by using this prior art system.

U.S. Pat. No. 4,177,034 describes an adjustable bracket assembly that can be employed to hold an igniter electrode in position in a variety of different configurations. The device includes a flat metal stamping having a web with distal apertures bearing upstanding peripheral flanges about each aperture, and two pairs of bendable tabs. The device requires removing the entire burner assembly before removing the igniter electrode. Once the entire assembly is removed maintenance personnel must then use a special tool to remove the snap ring that holds the igniter in place. After the snap ring is detached the igniter can be extracted. An apparatus requiring the removal of the entire burner assembly is not a solution to minimizing the labor needed to replace an igniter.

U.S. Pat. No. 5,464,345 discloses the use of another type of igniter holder for securing an igniter with respect to a gas flame burner. An apparatus that must be completely disassembled to gain access to the burner significantly increases the cost of maintaining the unit. The apparatus requires the burner head assembly to be removed in order to gain access to the igniter. The prior art apparatus was to be used only with special igniter electrodes that have an "L"-shaped form. Similarly, as in other cited prior art devices, no provision is made for easily removing of the igniter.

U.S. Pat. No. 4,846,671 describes the use of a snap in ring to hold the igniter in position. The removal of an igniter from this device requires the use of special tools as well as both hands. Snap rings are not functional as they are prone to rusting. A rusted snap ring can be almost as difficult to remove as a rusted threaded fastener. The problem of convenient, easy installation and removal of igniter is not solved by this invention.

U.S. Pat. No. 4,854,857 discloses the use of dimples in a sleeve to hold the igniter in position. Only special electrodes which can fit inside the sleeve dimensions and having a special rim feature may be used. The dimensions of the sleeve and the dimples do not allow for flexibility in choosing electrodes. Complex igniter electrodes require manufacturing changes that reduce the economic benefit recovered from saved maintenance costs by using this prior art system. The electrodes once secured require significant force to remove. An apparatus that requires the use of significant force does not lend itself to ease of removal.

U.S. Pat. No. 2,881,363 discloses another type of igniter prior art electrode. According to this design the igniter electrode has a ball fixture mounted in the center of the electrode body. The burner assembly includes a ball socket receiver integrated into it to receive the igniter electrode. The alternative prior art approach requires the redesign of the igniter electrode and a complex structure incorporated into the burner assembly. Complex structures are not suited for all applications and defeat the economic advantages of standardization.

SUMMARY OF THE INVENTION

It can now be understood there is a great need for a universal housing for a hot surface igniter which allows the end user, consumer to easily remove and replace an igniter without the need for specialized tools or assistance from maintenance personnel.

Therefore, the present invention provides a universal housing for containment therein of a hot surface igniter assembly. It is to be noted any suitable type of hot surface igniter of engineering choice is useable with the igniter housing of the present invention. Thus, the components and operational perimeters of the igniter itself is not addressed herein as such is well known within the field of art.

The present hot surface igniter housing includes a holder for containment of an igniter therein and a base for receiving the holder therein. Various embodiments are herein disclosed for interconnecting the holder and base together.

OBJECTS AND ADVANTAGES

It is therefore a primary object of the present invention to provide a universal igniter installation housing which requires no specialized tools for removal or installation and can be installed/removed with only one hand.

It is a further object to provide a universal igniter installation housing which is of simple construction of which utilizes and requires only two interconnecting components. Each of the components can be easily interconnected together by attachment means of engineering choice. Including but not limited to a bayonet fitting, threads, frictionally engaged, combinations thereof, or the like.

Yet another object is to provide a universal igniter installation housing which can be easily manufactured, produced and sold in a cost effective manner.

Still a further object is to provide a universal igniter installation housing which can be made from any suitable materials of engineering choice. Including but not limited to metal, stainless steel, ceramic, combinations thereof, etc.

Another object is to provide a universal igniter installation housing which is appealing to manufacturers of a device which requires a hot surface igniter as the manufacturer need not design a specialized receptacle for the igniter.

A further object is to provide a universal igniter installation housing which is usable with substantially any apparatus, device which requires a hot surface igniter. Including but not limited to stove tops, heaters, dryers, electric barbeques, scientific machines, infrared light sources, etc.

Other objects and advantages will become apparent when taken into consideration with the following specification and drawings.

BRIEF DESCRIPTION OF THE DRAWINGS

FIG. 1 is a front side plan view of the first embodiment for the present invention.

FIG. 2 is a right side plan view of the first embodiment for the present invention.

FIG. 3 is a front side plan view of the second embodiment for the present invention.

FIG. 4 is a front side plan view of the third embodiment for the present invention.

DETAILED DESCRIPTION OF THE DRAWINGS

Figure 6:
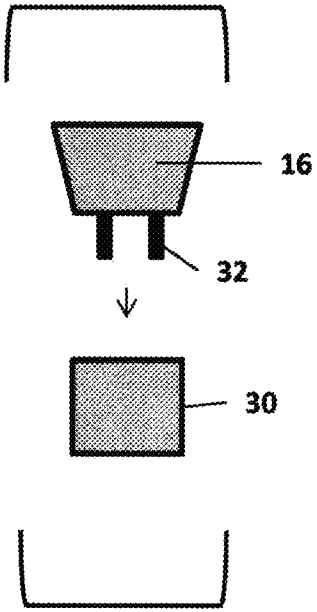
FIG. 6 is a front side plan view of the fifth embodiment for the present invention.

Referring now in detail to the drawings wherein like characters refer to like elements throughout the various views. FIG. 1 represents a first embodiment for a universal housing for a hot surface igniter used for installation within an apparatus represented by reference character (10). The universal housing (10) comprising an igniter element (12), a holder (14) and a base (16). The igniter element (12) is fixedly mounted within the holder (14) by any suitable attachment means of engineering choice. The holder (14) includes standard hot surface igniter components therein (not shown). Many types of igniter components are taught and well known within the field of art, thus the actual components and functional details are not taught herein. The holder (14) includes a standard insulated positive terminal (18) extending downwardly therefrom. The base (16) includes standard components therein such as a spring loaded terminal (not shown) or the like. The base (16) includes standard electrical leads (20) extending downwardly therefrom for electrical connection to the apparatus and the holder (14) is interconnected to the base (16). It is to be noted the holder (14) and the base (16) may be integrally manufactured as one unit or removeably interconnected together by detachment means of engineering choice. Various types of detachment means are depicted and described within the following specification. However, the invention is not to be limited thereto as alternative detachment means are inherent.

As illustrated in FIGS. 1 and 2 a suitable type of detachment means is a bayonet fitting wherein the holder (14) is cylindrical having at least one outwardly projecting radial pin (22). The base (16) is also cylindrical having at least one I-shaped slot (24) for slide ably receiving and retaining the outwardly projecting radial pin (22) therein. The bayonet fitting may further include a spring (not shown) and the L-shaped slot (24) includes a short upward segment at the end of the horizontal arm forming a serif (26). Whereby, when the outwardly projecting radial pin (22) is slide ably engaged downwardly into the vertical arm of the L-shaped slot (24) then rotated horizontally the spring urges the outwardly projecting radial pin (22) upward into the serif (26). Whereby the bayonet fitting is no longer free to rotate unless the holder (14) is pushed downward against the spring then rotated releasing the pin (22) from within the serif (26).

As illustrated in FIG. 3 another suitably type of detachment means is depicted. Wherein the holder (14) is cylindrical having external male threads (14-*a*) and the base (16) is cylindrical having internal female threads (not shown). Whereby the holder (14) and the base (16) are remove ably thread ably engaged.

As illustrated in FIG. 4 another suitably type of detachment means is depicted. Wherein the holder (14) is in the shape of a small wedge and the base (16) is in the shape of a large wedge. Whereby the small wedged shaped holder (14) and the large wedged shaped base (16) are frictionally engaged together when interconnected.

Figure 5:
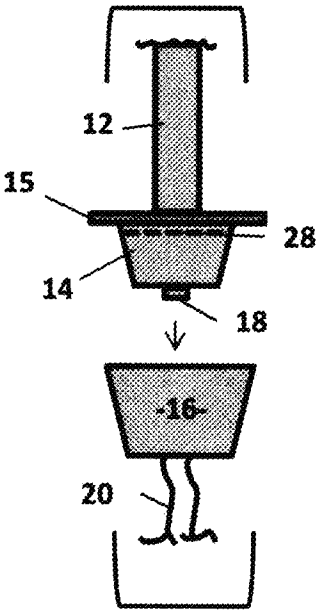
FIG. 5 is a front side plan view of the forth embodiment for the present invention.

As illustrated in FIG. 5 the universal housing of the present invention may further include a type of sealing means of engineering choice. For example a suitable sealing means may include the holder (14) having an outwardly projecting rim (15) and an O-ring (28) which is frictionally retained beneath the rim (14-*a*).

As illustrated in FIG. 6 the universal housing (10) may be modified and utilized for attachment to a typical terminal plug (30) such as a Molex® or the like. Wherein the base (16) includes standard electrical terminals (32) extending downwardly therefrom for electrical connection to the terminal plug (30).

It can now be seen herein provided is a universal housing for a hot surface igniter which is of simple construction, easy to install/remove and is usable with substantially any apparatus or device which requires a hot surface igniter. Including but not limited to stove tops, heaters, dryers, electric barbeques, scientific machines, infrared light sources, etc. Also, the universal housing can be made from any suitable materials of engineering choice. Including but not limited to metal, stainless steel, ceramic, combinations thereof, etc.

Although the invention has been herein shown and described in what is conceived to be the most practical and preferred embodiment, it is recognized that departures may be made there from within the scope and spirit of the invention, which is not to be limited to the details disclosed herein but is to be accorded the full scope of the claims so as to embrace any and all equivalent devices and apparatuses.

Having described the invention, what I claim as new and desire to secure by Letters Patent is:

1. A universal housing for a hot surface igniter used for installation within an apparatus comprising:

a base having a pair of electrical leads extending downwardly therefrom for electrical connection to the apparatus;

a holder having at least a first end and a second end opposite the first end, the first end comprising an insulated positive terminal extending downwardly therefrom for electrical connection to the base;

an igniter element fixedly mounted at the second end of the holder, and terminating in a protruding portion extending therefrom, the igniter configured to radiate heat upon receiving an electrical charge through the electrical connection in the base and positive terminal in the holder;

wherein the igniter element is substantially free of insulation along its entirety; and wherein the holder and said base are removably interconnected together by a detachment means.

2. The universal housing of claim 1 wherein said holder and said base are removably interconnected together by detachment means.

3. The universal housing of claim 2 wherein said detachment means is a bayonet fitting comprising; said holder being cylindrical having at least one outwardly projecting radial pin, said base being cylindrical having at least one L-shaped slot for slideably receiving and retaining said outwardly projecting radial pin therein.

4. The universal housing of claim 3 wherein said bayonet fitting further includes a spring, said L-shaped slot having a short upward segment at the end of a horizontal arm forming a serif, whereby, when said outwardly projecting radial pin is slideably engaged downwardly into a vertical arm of said L-shaped slot then rotated horizontally said spring urges said outwardly projecting radial pin upward into said serif, whereby said bayonet fitting is no longer free to rotate unless said holder is pushed downward against said spring then rotated releasing said pin from within said serif.

5. The universal housing of claim 2 wherein said detachment means comprising; said holder is cylindrical having external male threads and said base is cylindrical having internal female threads, whereby said holder and said base are remove ably threadably engaged.

6. The universal housing of claim 2 wherein said detachment means comprising; said holder being in the shape of a small wedge, said base being in the shape of a large wedge, whereby said small wedge and said large wedge are frictionally engaged when interconnected.

7. The universal housing of claim 1 further includes sealing means comprising; said holder having an outwardly projecting rim and an O-ring frictionally retained beneath said rim.

8. The universal housing of claim 1 wherein said apparatus is from the group of any apparatus requiring use of a hot surface igniter.

9. The universal housing of claim 1 is made from one of metal, stainless steel, ceramic, and combinations thereof.

10. A universal housing for a hot surface igniter used for installation within an apparatus comprising:

a base having a pair of electrical leads extending downwardly therefrom for electrical connection to said apparatus;

a holder having at least a first end and a second end opposite the first end, the first end comprising an insulated positive terminal extending downwardly therefrom for electrical connection to a terminal plug on the base;

an igniter element fixedly mounted at the second end of the holder, and terminating in a protruding portion extending therefrom, the igniter configured to radiate heat upon receiving an electrical charge through the electrical connection in the base and positive terminal in the holder;

wherein the igniter element is substantially free of insulation along its entirety; and wherein the holder and the base are removably interconnected together by a detachment means.

* * * * *